US010024084B2

(12) United States Patent
Choi

(10) Patent No.: US 10,024,084 B2
(45) Date of Patent: Jul. 17, 2018

(54) SLIDING DOOR LATCH FOR VEHICLE

(71) Applicant: Hyundai Motor Company, Seoul (KR)

(72) Inventor: Jae Hong Choi, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 349 days.

(21) Appl. No.: 14/883,902

(22) Filed: Oct. 15, 2015

(65) Prior Publication Data

US 2016/0348409 A1 Dec. 1, 2016

(30) Foreign Application Priority Data

Jun. 1, 2015 (KR) ..... 10-2015-0077603

(51) Int. Cl.

| | |
|---|---|
| ***E05C 3/02*** | (2006.01) |
| ***E05B 83/40*** | (2014.01) |
| ***E05B 79/20*** | (2014.01) |
| *E05B 85/04* | (2014.01) |
| *E05C 7/00* | (2006.01) |

(52) U.S. Cl.

CPC ..... *E05B 83/40* (2013.01); *E05B 79/20* (2013.01); *E05B 85/045* (2013.01); *E05C 2007/007* (2013.01)

(58) Field of Classification Search

CPC ..... B60J 5/06; B60J 5/0479; E05Y 2900/531; E05Y 2201/22; E05Y 2600/31; E05Y 2800/11; E05Y 2201/708; E05B 83/40; E05B 79/20; E05B 85/04; E05B 85/20; E05B 85/26; E05F 11/54; E05F 15/632; E05F 5/003; E05C 17/60; E05C 2007/007; Y10S 292/23; Y10S 292/46

See application file for complete search history.

(56) References Cited

U.S. PATENT DOCUMENTS

| | | | | |
|---|---|---|---|---|
| 3,019,492 | A * | 2/1962 | Schimek | B60J 5/06 49/212 |
| 3,893,260 | A * | 7/1975 | Cadiou | B60J 5/06 49/362 |
| 5,069,000 | A * | 12/1991 | Zuckerman | B60J 5/06 49/214 |
| 5,836,639 | A * | 11/1998 | Kleefeldt | E05L 381/22 296/155 |
| 6,793,268 | B1 * | 9/2004 | Faubert | B60J 5/06 296/146.11 |
| 2009/0072583 | A1 * | 3/2009 | Elliott | B60J 5/0479 296/155 |

FOREIGN PATENT DOCUMENTS

| | | | |
|---|---|---|---|
| JP | 3199301 | B2 | 8/2001 |
| JP | 2005-336830 | A | 12/2005 |
| JP | 5294702 | B2 | 6/2013 |
| KR | 10-2015-0107436 | A | 9/2015 |

* cited by examiner

*Primary Examiner* — Mark A Williams

(74) *Attorney, Agent, or Firm* — Morgan, Lewis & Bockius LLP

(57) ABSTRACT

A sliding door latch for a vehicle may include a striker mounted on inner surfaces of a front sliding door and a rear sliding door opening a vehicle body opening formed in a vehicle body by moving forward and backward in a longitudinal direction of the vehicle, which faces a vehicle compartment, a latch device suspending the striker to fix or release the striker, and a release operating device configured to release the latch device by operating door handles installed in the front sliding door and the rear sliding door, respectively.

12 Claims, 4 Drawing Sheets

SLIDING DOOR LATCH FOR VEHICLE

CROSS-REFERENCE TO RELATED APPLICATION

The present application claims priority to Korean Patent Application No. 10-2015-0077603 filed Jun. 1, 2015, the entire contents of which is incorporated herein for all purposes by this reference.

BACKGROUND OF THE INVENTION

Field of the Invention

The present invention relates to a sliding door latch for a vehicle, and more particularly, to a sliding door latch for a vehicle, which detachably fixes a front sliding door and a rear sliding door which slidably move forward and backward in the longitudinal direction of the vehicle to open/close a door opening of a vehicle body, to the vehicle body.

Description of Related Art

In general, a vehicle compartment having a predetermined size, which a driver or an accompanied passenger thereof can board is formed in a vehicle and a vehicle compartment opening/closing door is installed in a vehicle body in order to open/close the vehicle compartment.

In the case of a car, the vehicle compartment opening/closing door includes a front sliding door installed in a front side of a car in the longitudinal direction of the vehicle and a rear sliding door installed in a rear side of the car in the longitudinal direction of the vehicle and the front sliding door and the rear sliding door are generally installed in a vehicle body to be rotatable via a hinge.

In the case of a van in which a lot of people can ride, the vehicle compartment opening/closing door is configured to open/close the vehicle compartment while slidably moving forward and backward in the longitudinal direction of the vehicle.

In the case of a sliding type vehicle compartment opening/closing door of the van, the vehicle compartment opening/closing door opens the vehicle compartment by moving backward in the longitudinal direction of the vehicle, and closes the vehicle compartment by moving forward in the longitudinal direction of the vehicle, and as a result, an opening/closing required space required for opening/closing the door is smaller than the hinge type vehicle compartment opening/closing door of the car and a door opening formed in the vehicle body can be fully opened even in the small opening/closing required space.

However, the sliding type vehicle compartment opening/closing door in the related art requires three support and guide rails supporting an upper portion, a middle portion, and a lower portion of the door while opening/closing the door and components related therewith to increase a weight and the number of components of the vehicle and degrade a degree of freedom of a design of the vehicle.

As a result, a 2-rail type vehicular sliding door is being developed, which supports the sliding door only with a door rail mounted on the vehicle compartment opening/closing door and a vehicle body rail mounted on the vehicle body to be slidably movable. In a 2-rail type vehicular sliding door, the development of a door latch became necessary, which can detachably fix a front sliding door and a rear sliding door to the vehicle body while the front sliding door and the rear sliding door close a vehicle body door opening.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a sliding door latch for a vehicle, which can detachably fix a front sliding door and a rear sliding door to a vehicle body while the front sliding door and the rear sliding door close a vehicle body door opening formed in a vehicle body and stably maintain a closed state of the front sliding door and the rear sliding door.

According to various aspects of the present invention, a sliding door latch for a vehicle may include a striker mounted on inner surfaces of a front sliding door and a rear sliding door opening a vehicle body opening formed in a vehicle body by moving forward and backward in a longitudinal direction of the vehicle, which faces a vehicle compartment, a latch device suspending the striker to fix or release the striker, and a release operating device configured to release the latch device by operating door handles installed in the front sliding door and the rear sliding door, respectively.

The latch device may include a striker suspension cam including a striker suspension groove suspending and fixing the striker, and a return spring configured to return the striker suspension cam to an original position after the striker suspension cam rotates.

The release operating device may include an operating cam configured to fix or release the striker suspension cam, an actuation wire connected to the door handle to be pulled or relaxed by operating the door handle, an actuation pin connected to the actuation wire and configured to be moved by the actuation wire when the actuation wire is pulled, a latch release pin configured to move with movement of the actuation pin to rotate the operating cam, and an operating wire connecting the latch release pin and the actuation pin.

The latch device may be installed to be supported on the vehicle body through a vehicle body mounting bracket.

The vehicle body mounting bracket may include each of a front side and a rear side in the longitudinal direction of the vehicle to have a C-shaped cross-section and may be formed such that a receiving groove in which a part of the striker when the front sliding door and the rear sliding door are closed is inserted and received is dug inside from an outside in a width direction of the vehicle on the front side and the rear side.

A front flange and a rear flange that extend in the longitudinal direction of the vehicle may be integrally formed on the front side and the rear side, respectively, and the striker suspension cam may be rotatably disposed on the front side and the rear side through a pin.

An operating groove may be formed at the striker suspension cam and a part of the operating cam may be inserted into and suspended on the operating groove.

The operating cam may be rotatably disposed on the front side and the rear side through the pin.

The guide grooves may be provided at the front flange and the rear flange to extend in the longitudinal direction of the vehicle, respectively and the latch release pins may be received in the guide grooves to move forward and backward in the longitudinal direction of the vehicle along the guide grooves.

The operating wire may be inserted through one or more bushes, and as a result, the operating wire may be disposed to be supported on the front flange and the rear flange.

Door mounting brackets may be fixedly mounted on the inner surfaces of the front sliding door and the rear sliding door, which face the vehicle compartment, and the striker may be disposed to protrude through the door mounting bracket.

A receiving groove dug outward toward an outside of the vehicle compartment from the inner surface facing the vehicle compartment may be formed at the door mounting bracket, and the actuation pin may be disposed in the receiving groove to move along the receiving groove.

A return spring may be disposed in the receiving groove in order to return the actuation pin to an original position after the actuation pin is pulled forward or backward in the longitudinal direction of the vehicle.

A wire holder may be disposed at an end of the actuation wire, and the actuation wire and the actuation pin may be connected to each other such that the wire holder is inserted into and coupled to a coupling groove provided at the actuation pin According to various embodiments of the present invention, by a sliding door latch for a vehicle, since door latches mounted on upper and lower vehicle bodies can catch and stably fix strikers of a front sliding door and a rear sliding door, a closed posture of the front sliding door and the rear sliding door can be stably maintained.

When the door latch is connected to a door handle through a wire and a user thus operates the door handle, the front sliding door and the rear sliding door can easily release the front sliding door and the rear sliding door to a vehicle body while the door latch is released through the wire.

Since the front sliding door and/or the rear sliding door can be fixed or released by only one door latch mounted on the vehicle body, the number of components, and a weight and cost of the door latch can be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
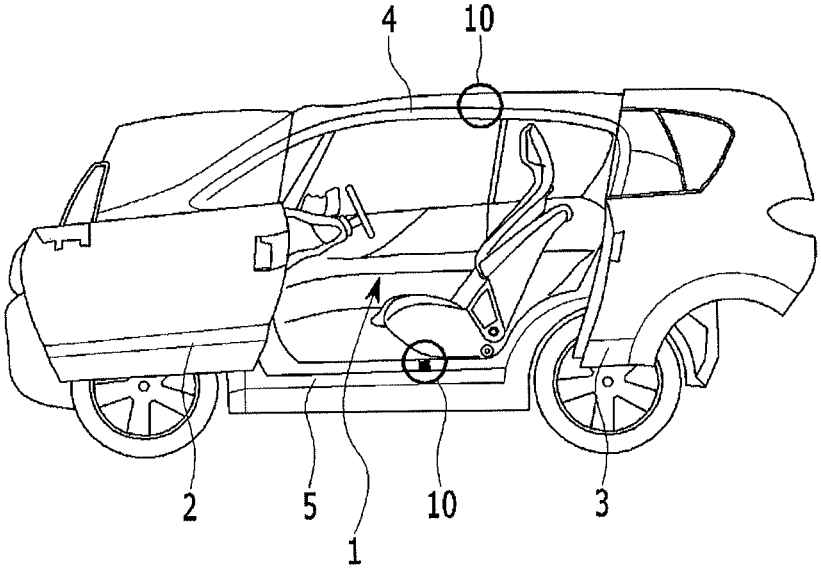
FIG. 1 is a perspective view of a state in which a sliding door of an exemplary sliding door latch for a vehicle fully opens a door opening of a vehicle body according to the present invention.

Referring to FIG. 1, a sliding door for a vehicle adopting a door latch according to various embodiments of the present invention may include a front sliding door 2 which moves forward in the longitudinal direction of a vehicle to open a vehicle body opening 1 and moves backward in the longitudinal direction of the vehicle to close the vehicle body opening 1 and a rear sliding door 3 which moves backward in the longitudinal direction of the vehicle to open the vehicle body opening 1 and moves forward in the longitudinal direction of the vehicle to close the vehicle body opening 1.

The vehicle body opening 1 may be formed substantially at a central portion in the longitudinal direction of the vehicle and forms one complete opening which is not partitioned by a center pillar of a car in the related art.

The sliding door latch 10 for the vehicle according to various embodiments of the present invention may be provided in an upper vehicle body 4 and/or a lower vehicle body 5.

Figure 2:
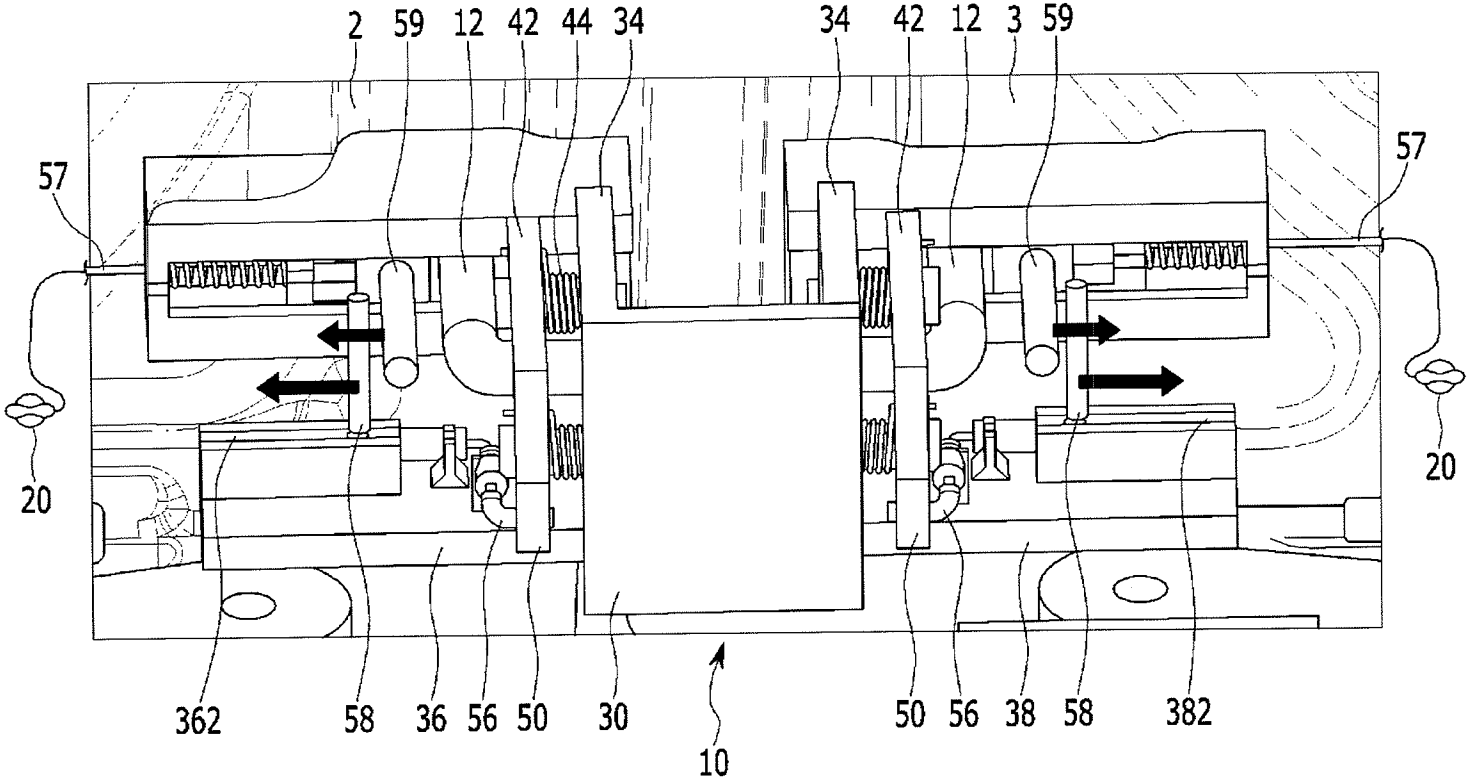
FIG. 2 is a front perspective view of the exemplary sliding door latch for a vehicle according to the present invention.
Figure 3:
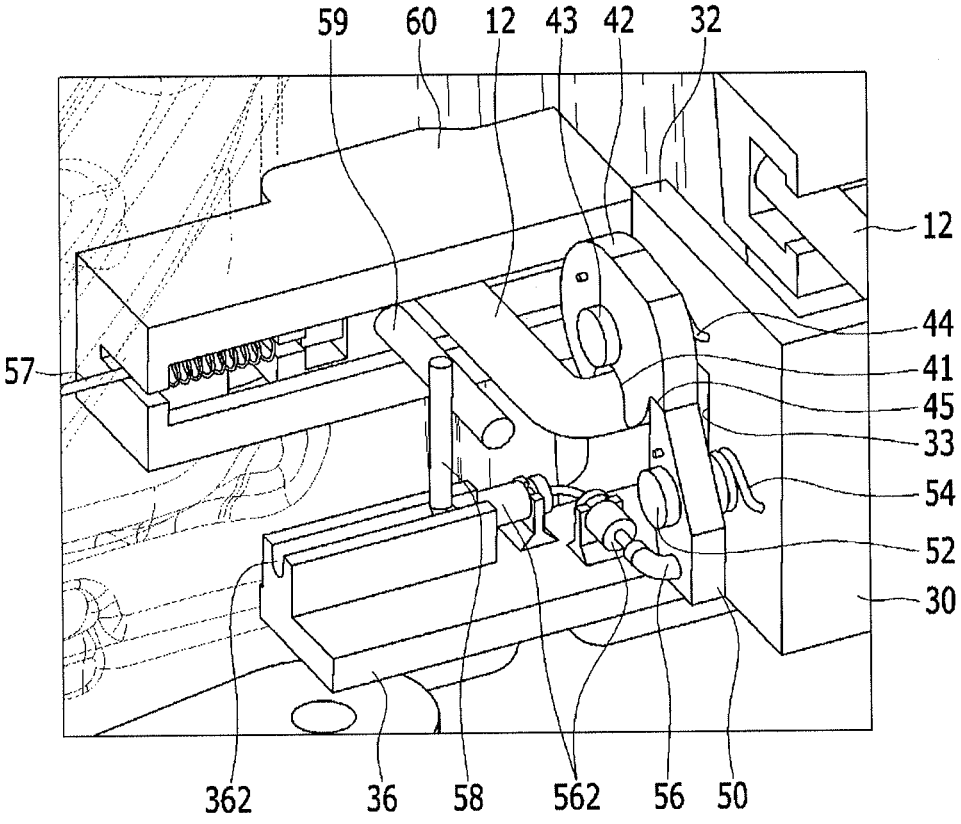
FIG. 3 is a front perspective view of the exemplary sliding door latch for a vehicle according to the present invention.

Referring to FIGS. 2 and 3, the door latch 10 may include strikers 12 mounted on inner surfaces of the front sliding door 2 and the rear sliding door 3 facing a vehicle compartment, respectively, a latch device locking and fixing or releasing the strikers 12, and a release operating device operating the latch device through a door handle 20 to release the latch device.

The latch device may be mounted to be supported onto a vehicle body through a vehicle body mounting bracket 30. The vehicle body mounting bracket 30 includes each of a front side 32 and a rear side 34 in the longitudinal direction of the vehicle to have a substantially C-shape cross-section and may be formed in such a manner that a receiving groove 33 in which a part of the respective strikers 12 when the front sliding door 2 and the rear sliding door 3 are closed is inserted and received is dug inside from the outside in the width direction of the vehicle on the front side 32 and the rear side 34.

A front flange 36 and a rear flange 38 that extend in the longitudinal direction of the vehicle may be integrally formed on the front side 32 and the rear side 34, respectively.

The latch device may include a striker suspension cam 42 rotatably installed on the front side 32 and the rear side 34 via a pin 43 with a striker suspension groove 41 suspending and fixing the striker 12.

A return spring 44 that returns the striker suspension cam 42 to an original position after the striker suspension cam 42 rotates may be installed to be rolled on the pin 43. One end of the return spring 44 is fixed to the front side 32 and the rear side 34 and the other end of the return spring 44 is fixed to the striker suspension cam 42 to serve to store elastic restoration force when the striker suspension cam 42 rotates and return the striker suspension cam 42 to the original position.

An operation groove 45 may be formed at the striker suspension cam 32 and a part of an operating cam 50 configuring the release operating device may be inserted and suspended into the operating groove 45.

The operating cam 50 may also be rotatably installed on each of the front side 32 and the rear side 34 via the pin 52, the return spring 54 that rotates the operating cam 50 to the original position may be installed to be rolled on the pin 52, one end of the return spring 54 may be fixed to the front side 32 and the rear side 34, and the other end of the return spring 54 may be fixed to the operating cam 50.

One end of an operating wire 56 may be fixedly connected to the operating cam 50 and the other end of the operating wire 56 may be connected to a latch release pin 58.

Guide grooves 362 and 382 are provided at the front flange 36 and the rear flange 38 to extend in the longitudinal direction of the vehicle, respectively and the latch release pins 58 are received in the guide grooves 362 and 382 to move forward and backward in the longitudinal direction of the vehicle along the guide grooves 362 and 382.

The operating wire 56 penetrates one or more bushes 562 to be inserted and one or more bushes 562 may be inserted into and supported on support grooves of one or more support protrusions having an appropriate shape, which are formed at the front flange 36 and the rear flange 38.

Figure 4:
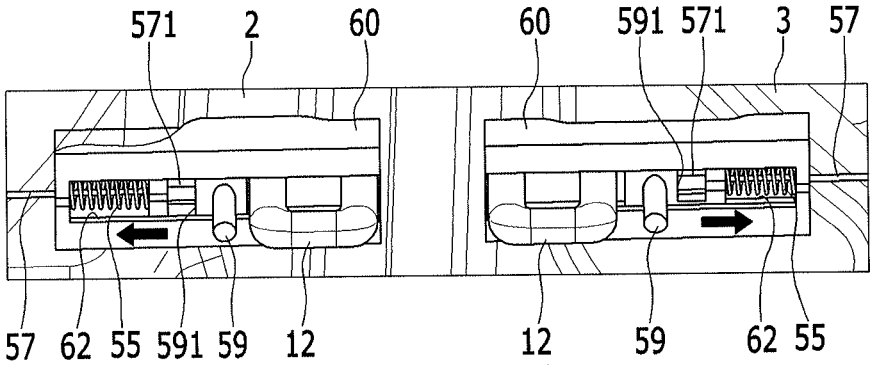
FIG. 4 is a perspective view of a primary part of the exemplary sliding door latch for a vehicle according to the present invention.

Referring to FIG. 4, door mounting brackets 60 may be fixedly mounted on the inner surfaces of the front sliding door 2 and the rear sliding door 3 facing the vehicle compartment.

The striker 12 may be installed to protrude through the door mounting bracket 60.

A receiving groove 62 which is dug outward toward the outside of the vehicle compartment from the inner surface facing the vehicle compartment may be formed in the door mounting bracket 60 and an actuation pin 59 may be installed in the receiving groove 62 to move along the receiving groove 62.

When the actuation pin 59 is connected to the door handle 20 through an actuation wire 57 and the door handle 20 of the front sliding door 2 is opened, the actuation wire 57 is pulled forward in the longitudinal direction of the vehicle to pull the actuation pin 59 forward in the longitudinal direction of the vehicle as shown by an arrow and when the door handle 20 of the rear sliding door 3 is opened, the actuation wire 57 is pulled backward in the longitudinal direction of the vehicle to pull the actuation pin 59 backward in the longitudinal direction of the vehicle as shown by an arrow.

A return spring 55 may be received in the receiving groove 62 in order to return the actuation pin 59 to an original position after the actuation pin 59 is pulled forward or backward in the longitudinal direction of the vehicle.

When the return spring 55 is contracted with movement of the actuation pin 59 and thereafter, the actuation wire 57 is relaxed, the return spring 55 pushes the actuation pin 59 to return the actuation pin 59 to the original position.

A wire holder 571 is installed at the end of the actuation wire 57 and the actuation wire 57 and the actuation pin 59 may be connected to each other in such a manner that the wire holder 571 is inserted into and coupled to a coupling groove 591 provided at the actuation pin 59.

By the sliding door latch for the vehicle of the present invention configured as above, each of the front sliding door 2 and the rear sliding door 3 may be fixed or released with one integrated latch.

Further, since the striker 12 of each of the front sliding door 2 and the rear sliding door 3 is suspended to be stably fixed by operating the striker suspension cam 42, a closing posture of the front sliding door 2 and the rear sliding door 3 may be stably maintained in the vehicle body.

In addition, the actuation wire 57 is pulled by operating the door handle 20 and the actuation pin 59 moves by the actuation wire 57 and since the operating cam 50 rotates to release the striker suspension cam 42 as the latch release pin 58 moves by the actuation pin 59 to pull the operating wire 56, the front sliding door 2 and the rear sliding door 3 may be easily opened.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A sliding door latch apparatus for a vehicle, the sliding door latch comprising:

a striker mounted on inner surfaces of a front sliding door and a rear sliding door, wherein the front sliding door and the rear sliding door are configured to open a vehicle body opening formed in a vehicle body in moving forward and backward in a longitudinal direction of the vehicle, the inner surfaces of the front sliding door and the rear sliding door being positioned to face a vehicle compartment;

a latch device selectively fixing the striker; and a release operating device configured to release the latch device by operating door handles installed in the front sliding door and the rear sliding door, respectively, wherein the latch device includes:

a striker suspension cam including a striker suspension groove selectively fixing the striker; and a return spring configured to return the striker suspension cam to an original position after the striker suspension cam rotates, and wherein the release operating device includes:

an operating cam configured to fix or release the striker suspension cam;

an actuation wire connected to the door handle to be pulled or relaxed by operating the door handle;

an actuation pin connected to the actuation wire and configured to be moved by the actuation wire when the actuation wire is pulled;

a latch release pin configured to move with movement of the actuation pin to rotate the operating cam; and an operating wire connecting the latch release pin and the actuation pin.

2. The sliding door latch apparatus of claim 1, wherein the latch device is installed to be supported on the vehicle body through a vehicle body mounting bracket.

3. The sliding door latch apparatus of claim 2, wherein the vehicle body mounting bracket includes each of a front side and a rear side in the longitudinal direction of the vehicle to have a C-shaped cross-section and is formed such that a receiving groove in which a part of the striker when the front sliding door and the rear sliding door are closed is inserted and received is dug inside from an outside in a width direction of the vehicle on the front side and the rear side.

4. The sliding door latch apparatus of claim 3, wherein:

a front flange and a rear flange that extend in the longitudinal direction of the vehicle are integrally formed on the front side and the rear side, respectively, and the striker suspension cam is rotatably disposed on the front side and the rear side through a pin.

5. The sliding door latch apparatus of claim 4, wherein an operating groove is formed at the striker suspension cam and a part of the operating cam is inserted into the operating groove.

6. The sliding door latch apparatus of claim 4, wherein the operating cam is rotatably disposed on the front side and the rear side through the pin.

7. The sliding door latch apparatus of claim 4, wherein guide grooves are provided at the front flange and the rear flange to extend in the longitudinal direction of the vehicle, respectively and the latch release pins are received in the guide grooves to move forward and backward in the longitudinal direction of the vehicle along the guide grooves.

8. The sliding door latch apparatus of claim 4, wherein the operating wire is inserted through one or more bushes, and as a result, the operating wire is disposed to be supported on the front flange and the rear flange.

9. The sliding door latch apparatus of claim 1, wherein:

door mounting brackets are fixedly mounted on the inner surfaces of the front sliding door and the rear sliding door, and the striker is disposed to protrude through the door mounting bracket.

10. The sliding door latch apparatus of claim 9, wherein:

a receiving groove dug outward toward an outside of the vehicle compartment from the inner surfaces facing the vehicle compartment is formed at the door mounting bracket, and the actuation pin is disposed in the receiving groove to move along the receiving groove.

11. The sliding door latch apparatus of claim 10, wherein a return spring is disposed in the receiving groove in order to return the actuation pin to an original position after the actuation pin is pulled forward or backward in the longitudinal direction of the vehicle.

12. The sliding door latch apparatus of claim 10, wherein:

a wire holder is disposed at an end of the actuation wire, and the actuation wire and the actuation pin are connected to each other such that the wire holder is inserted into and coupled to a coupling groove provided at the actuation pin.

* * * * *